United States Patent [19]

Grix et al.

[11] Patent Number: 4,904,872

[45] Date of Patent: Feb. 27, 1990

[54] METHOD FOR GENERATING EXTREMELY SHORT ION PULSES OF HIGH INTENSITY FROM A PULSED ION SOURCE

[76] Inventors: Raimund Grix, Rheinfelserstr. 38, D-6300 Giessen; Roland Kutscher, Bahnhofstr. 109, D-6307 Linden; Gang Q. Li, Unterhof 61, D-6300 Giessen; Hermann Wollnik, Auf der Platte 30, D-6301 Fernwald 2, all of Fed. Rep. of Germany

[21] Appl. No.: 200,024

[22] Filed: May 27, 1988

[51] Int. Cl.[4] ..... H01J 49/10

[52] U.S. Cl. ..... 250/423 R; 250/424; 250/287; 250/286; 313/230; 313/359.1

[58] Field of Search ..... 250/423 R, 424, 287, 250/290, 291, 286; 313/359.1, 230

[56] References Cited

U.S. PATENT DOCUMENTS

| | | | |
|---|---|---|---|
| 2,772,364 | 11/1956 | Washburn | 250/41.9 |
| 3,258,592 | 6/1966 | Blauth et al. | 250/286 |
| 3,553,452 | 1/1971 | Tiernan et al. | 250/287 |
| 3,922,543 | 11/1975 | Beauchamp | 250/291 |
| 3,937,955 | 2/1976 | Comisarow et al. | 250/283 |
| 4,072,862 | 2/1978 | Mamyrina et al. | 250/287 |
| 4,105,917 | 8/1978 | McIver, Jr. et al. | 250/292 |
| 4,422,013 | 12/1983 | Turchi et al. | 313/359.1 |
| 4,620,102 | 10/1986 | Watanabe et al. | 250/427 |
| 4,633,084 | 12/1986 | Gruen et al. | 250/307 |

OTHER PUBLICATIONS

"Time-of-Flight Mass Spectrometer with Improved Resolution", *Rev. Sci. Instrum.* 26(12), Dec. 1955, pp. 1150–1157, Authors: W. C. Willis and I. H. McLaren.

"Electron-Impact Ionization Time of Flight Mass Spectrometer for Molecular Beams", *Rev. Sci. Instrum.* 58(1), Jan. 1987, pp. 32–37, Authors: J. E. Pollard and R. B. Cohen.

*Primary Examiner*—Jack I. Berman

*Attorney, Agent, or Firm*—Flehr, Hohbach, Test, Albritton & Herbert

[57] ABSTRACT

In a method for generating extremely short ion pulses having a high intensity and a pulsed ion source to generate extremely short ion pulses having a high intensity, the ions are generated by an electron, laser or particle beam and are stored in a potential well formed by at least three electrodes, at least one of the central electrodes having a more attractive potential for the ions in question than the other electrodes. A single electrical pulse is used for extracting the ions from the potential well. Correspondingly constructed pulsed ion sources are particularly suitable for use in time-of-flight mass spectrometry. The ion storage effect is produced by a number of electrodes which generate a potential well for the ions to be detected. The ion compression is determined by the field strength existing during the ion extraction in the ion source which should be approximately equal in the entire area of acceleration.

31 Claims, 3 Drawing Sheets

METHOD FOR GENERATING EXTREMELY SHORT ION PULSES OF HIGH INTENSITY FROM A PULSED ION SOURCE

The invention includes a method for generating extremely short ion pulses from a novel ion source that is simple to implement technically and has the characteristics of ion storage and compression of ions in time. Because of these characteristics, the source is particularly suitable for use in time-of-flight mass spectrometry. It can be used most advantageously in a suitable time-of-flight mass spectrometer using an ion reflector to obtain mass spectra with good mass resolution. At the same time, the ion storage results in a high ion yield as a result of which the problem of long measuring times, frequently occurring in time-of-flight mass spectrometry, is considerably reduced.

With a suitable choice of source geometry and of the source potentials, extremely short ion pulses can be achieved with long storage times, that is to say high ion intensities in an ion pulse. The ion source is therefore also suitable as primary ion source for a secondary ionization time-of-flight mass spectrometer.

The short ion pulse lengths combined with high ion intensities desired for the two abovementioned applications are achieved with extraordinarily little mechanical or electronic expenditure in the invention.

BACKGROUND OF THE INVENTION

The resolving power of a time-of-flight mass spectrometer in general is decisively determined by the initial pulse length of the ion bunch generated in the ion source. Therefore the ions are usually generated in the ion source by an electrical pulse or laser or particle pulse having lengths which are as short in time as technically possible. When ions are generated by means of these methods, either elaborate pulsed laser systems are needed which are partly combined with pulsed lasers, for positioning of the desorbed neutral particles, or a high electronic and instrumentation effort is required to generate a very short and intense particle pulse that causes the ionization.

The invention is a decisive advance because the pulsed ion generation can be dispensed with and can be replaced by a much more easily implemented continuous ion generation with the same ionization mechanisms.

To extract ions from a relatively large volume, the construction of and the potential distribution in the new ion source allows to use of electrical pulses that are relatively long and thus technically easily can be achieved.

SUMMARY AND OBJECTS OF THE INVENTION

In this method the ion bunches, which are desired to be as short as possible, are formed after the ions have left the ion source, independently of the location where the ions have started in the storage volume. This meets the necessary prerequisite for high mass revolving power of a spectrometer. The length of the compressed ion bunch depends on the spacing of the electrodes in the ion source, for example, the size of the storage volume, on the ion energy and on the ion mass. Depending on the type of application, the geometry and the potentials of the ion source can be numerically adapted and optimized.

Compared with ion sources having pulsed ion generation, the yield of ions is considerably increased by the invention in that generated ions are stored before extraction. This is caused by a potential well in which the number of ions generated inside the well or which have entered the well with low energies increases until an equilibrium has been reached between the rate of ion buildup and the recombination rate. In the special embodiment of the invention as electron impact ion source, described in detail in embodiment 1, the potential distribution in the potential well is modified additionally by the electrical charges of the electron current causing the ionization. The potential of the electrodes must therefore be slightly varied depending on the intensity of the electron current used.

An electron impact ion source especially for time-of-flight mass spectrometers has already been built by W. C. Wiley and I. H. McLaren in 1955 (Rev. Sci. Instr., 26, 12, 1955, pp. 1150–1157). In contrast to this ion source, the invention described here exhibits a number of differences and corresponding advantages:

(a) It is of simpler construction both mecanically and from the point of view of electronic supply since a continuous electron beam is required for ion generation and only a single electrical pulse for extraction. In the Wiley-McLaren ion source, in contrast, the beam must already be pulsed so that the ion extraction pulse occurs with respect to the electron beam.

(b) A high sensitivity of the novel ion source, among other things, can be achieved by an annular arrangement of the cathode around the ionization volume. This causes the ionizing electrons to enter the ionization volume from a large range of solid angles and thus an increase in the rate of ion formation. In addition, a large number of ions can be stored in the large effective ionization volume. In contrast, the Wiley-McLaren ion source, due to its principle, must use as small an ionization volume as possible, where ionization occures by means of an electron beam from only one direction. Futhermore the formed ions are not stored.

The higher sensitivity of the novel ion source thus achieved allows, for example, residual gas analysis at pressures in the ultra-high vacuum range with a good signal/noise ratio.

(c) The conditions for the distribution of the ion accelerating electrical field that causes an optimum ion compression are basically different in the novel ion source compared to the case of the Wiley-McLaren ion source due to the large ionization volume.

Embodiments of the invention are shown in the drawings and are explained in greater detail in the following text.

DETAILED DESCRIPTION OF PREFERRED EMBODIMENTS

Example 1

Figure 2:
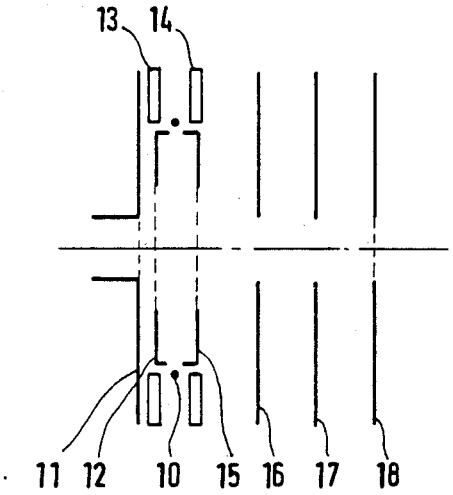
FIG. 2 shows a schematic diagram of the ion source.

The principal embodiment of the invention as electron impact ion source is shown in FIG. 2. The electrons causing the ionization are formed by the cathode 10 heated by means of a regulated electric direct current and are accelerated into the ionization volume. The cathode 10 consists of a not completely closed annular metal wire of approximately 0.2 mm thickness. The energy of the electrons is determined by the potential difference between the electrodes 11, 12 and 15 the potentials of which are very similar, and the potential of the cathode 10. Depending on the type of application, the electron energy can be varied between approximately 5 eV and 200 eV, resulting in high ion yields even with very low electron energies. To introduce the electrons efficiently into the ionization volume between the electrodes 12 and 15, the electrodes 13 and 14 are held at a slightly negative potential with respect to the cathode 10, thus serving as electron pushers. During the ion storing phase the potential of the electrode 15 is slightly more positive (0.5 V–2 V) than the potential of the electrode 12. The potential of the electrode 11 is equal to the potential of the electrode 15 or more positive. The electrode 12 thus has an attractive potential for positive ions causing these ions to be held back in the potential well between the electrodes 12 and 15. After some time, at the rate of a few milliseconds as a rule, the ions are extracted by an electric pulse, applied to the central electrode 12 for a few microseconds, and further accelerated in the then approximately linear potential drop between the electrodes 12 and 18. The electrode 18 is at ground potential as a rule and the electrodes 16 and 17 ensure that the potential drop is linear.

Figure 1:
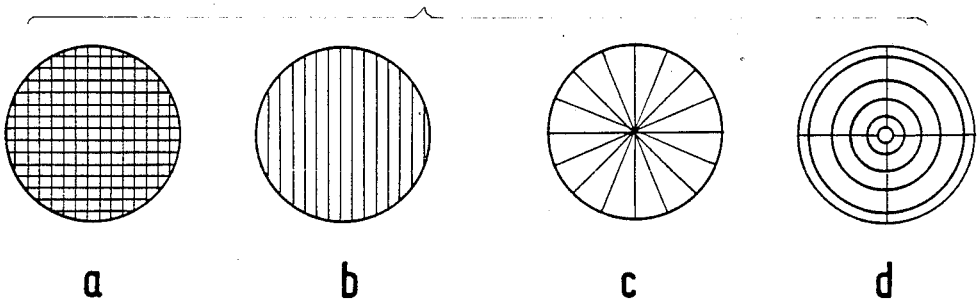
FIGS. 1, *a* to *d*, show various designs of the electrodes of a pulsed ion source according to the invention.
Figure 3:
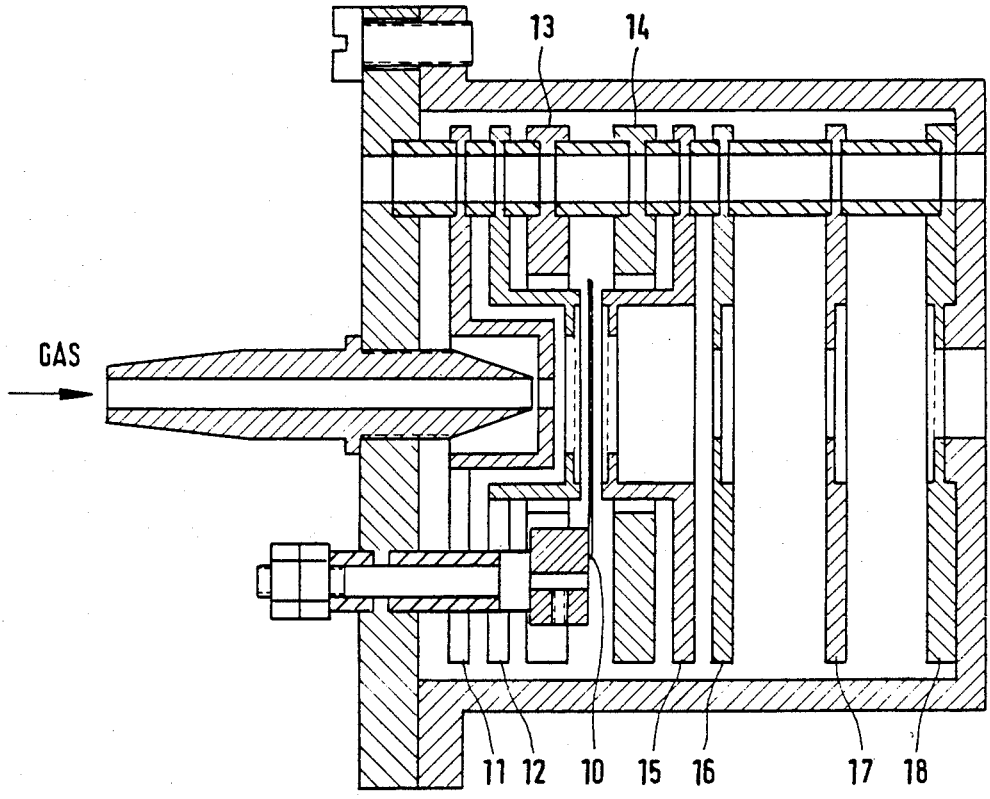
FIG. 3 shows a real ion source corresponding to the principal design of FIG. 2.

With the exception of the cathode heating current, the various ion source potentials can either be obtained from a common power supply by means of a suitable voltage divider or by means of separate power supplies. FIG. 3 shows a particular technical embodiment of the electron impact source according to FIG. 2. All electrodes 11 to 18 are manufactured of stainless steel (V2A). The electrical insulation of the various electrodes consists of ceramic tubes which, at the same time, ensure accurate allignment. The electrodes 12, 15 and 18 support a metal wire grid according to FIG. 1A. Other embodiments of this metal wire grid are possible. Some of these embodiments are shown in FIGS. 1*b*, 1*c* and 1*d*.

The ion source potentials for the storing phase of the ions and during their extraction are specified for two different ion energies in table 1:

TABLE 1

| | Ion energy 500 eV | | Ion energy 1000 eV | |
|---|---|---|---|---|
| Electrode | Storing | Extraction | Storing | Extraction |
| 11 | 503V | 503V | 1003V | 1003V |
| 12 | 500V | 541V | 1000V | 1082V |
| 13 | 350V | 350V | 740V | 740V |
| 14 | 360V | 360V | 750V | 750V |
| 15 | 501V | 501V | 1001V | 1001V |
| 16 | 334V | 334V | 667V | 667 |
| 17 | 167V | 167V | 333V | 333V |
| 18 | 0V | 0V | 0V | 0V |
| 10 | 430V | 430V | 930 | 930V |

Naturally, to achieve optimum results, these potentials must be slightly varied as functions of electron energy and electron current. In this embodiment, the distance between electrodes 12 and 15 is about 2 mm, the distance between electrodes 15 and 18 is about 25 mm. As a result, a time focus for the ions is formed approximately 52 mm behind the ground electrode 18.

Example 2

Figure 4A:
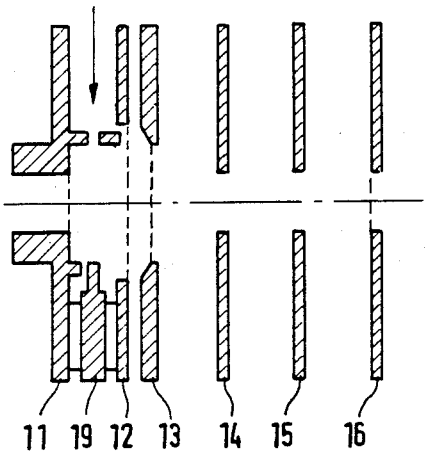
FIG. 4*a* shows a schematic diagram of an ion source in which the ions are generated on a target by means of laser or particle radiation.

In the schematic embodiment of FIG. 4*a*, the ions are generated on the target 19 by pulsed or preferably continuous laser or particle radiation (arrow). In this arrangement, the area of the target 19 is only a small part of the total surface of the storage volume as a result of which the influence on the potential distribution in this volume is also small. The direction of incidence of the beams is transverse with respect to the extraction of the ions. After a particular collecting time of the ions in the storage volume between the electrodes 11 and 13, the ions are extracted by an electrical pulse.

Electrode 12 has a slightly more negative potential than the electrode 11 and 13 for analyzing positively charged ions and a slightly more positive value for analyzing negatively charged ions. In this arrangement, the potential of the target 19 usually is still slightly below the potential of the electrode 12 since the ions generated at the target have a low initial energy.

For optimum extraction of the ions, either the static potential of electrode 11 can be adjusted relative to 12 such that a corresponding pulse applied to electrode 13 results in an optimum field strength according to claim 5 for optimum time focusing, or pulsing either the electrode 12 (according to Example 1), or the electrode 12 together with electrode 11 appropriately. This joint pulsing can be achieved either via an appropriately dimensioned voltage divider or via separate pulse generators.

Example 3

Figure 4B:
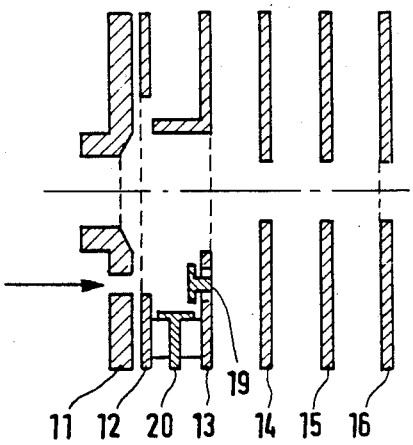
FIG. 4*b* shows a schematic diagram of an ion source in which the particles or beams causing the ionization enter parallel to the extracted ion beam.

In this embodiment (FIG. 4*b*) of the invention, an ion source is shown as in Example 2, which allows time-of-flight mass spectrometry with desorbed ions. The difference with respect to Example 2 is the fact that the particles or beams causing the ionization (as in Example 2) enter parallel to the extracted ion beam. In this arrangement, the potential relationships are slightly different from Example 2. The target 19 has approximately the potential of electrode 12, the electrode 20 has a slightly higher potential and is used as pusher for the ions created by particle bombardment. In this arrangement of the electrodes, as in Example 1, it is possible to pulse only electrode 12. However the electrodes 11 and 12 can also be jointly provided with an electrical pulse in order to obtain a higher yield of ions.

Example 4

Figure 5:
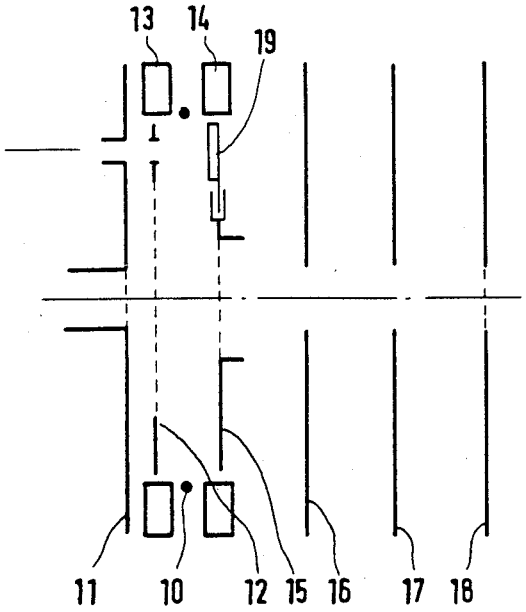
FIG. 5 shows a schematic diagram of an ion source, in which different methods of ionization, in particular an electron impact and a desorption ion source are combined.

In FIG. 5, an embodiment of the described ion source is shown which allows very different types of ionization in one ion source, in order to obtain efficient time-of-flight mass spectra. The combination of an electron impact ion source with a desorption ion source, as described in Example 1 and Example 3, is shown. The operation as electron impact ion source is almost identical to that described in Example 1. For the operation as a desorption ion source, the cathode 10 and the electrodes 13 and 14 are used as ion pushers. The target 19 is electrically insulated from the electrode 15 and has approximately the same potential as the electrode 12.

In this embodiment of the ion source, either only the electrode 12 or the electrodes 12 and 11 are pulsed simultaneously.

We claim:

1. A method for generating ion pulses for a time-of-flight mass spectrometer where an ion source generates ions by an electron, laser, or particle beam comprising the following steps:

storing said generated ions in a storage volume by providing in said volume a potential well of an electrical field, said well being formed of at least three electrodes with an intermediate central electrode;

imposing on said central electrode a potential which is more attractive for said generated ions relative to said other of said electrodes during said generating and storing of said ions;

and thereafter extracting ions from said storage volume by a single electrical pulse whereby said ion pulses are generated.

2. Method as claimed in claim 1, wherein the ions are generated by a continuous electron beam.

3. Method as claimed in claim 2, wherein the electrons causing the ionization are generated by a cathode, heated by means of a regulated electrical direct current, which is essentially annularly arranged around the potential well.

4. Method as claimed in one of claims 1 to 3, wherein the ions are generated on a target by pulsed or continuous laser or particle radiation, the target assuming only a small area of the total surface of the storage volume.

5. Method as claimed in claim 4, wherein the direction of incidence of the laser or particle radiation extends transversely or parallel to the direction of extraction of the ions.

6. Method as claimed in claim 1, wherein the ions are extracted only when an equilibrium between the rate of ion buildup and the recombination rate has occurred in the potential well.

7. Method as claimed in claim 1, wherein the potential of the more attractive electrode is lower by 0.2 V to 5 V than that of the remaining central electrodes.

8. Method as claimed in claim 1, wherein the ions are extracted by means of an electrical pulse having a length of a few microseconds.

9. Method as claimed in claim 8, wherein the time interval between two successive extractions is a few milliseconds.

10. Method as claimed in claim 1, wherein the ions located in the potential well are extracted by static electrical fields which are arranged behind one another and/or are wholly or partially pulsed, and the electrical field is approximately equal in the entire area of acceleration during the extraction of the ions.

11. Method as claimed in claim 1, wherein the electrical pulse for ion extraction is applied to the said central electrode.

12. Method as claimed in claim 1, wherein the electrical pulse for ion extraction is applied to the electrode limiting the potential well to the rear.

13. Method as claimed in claim 11 or 12, wherein the electrical pulse for extraction of the ions is simultaneously applied to the said central electrode and to one or several of the adjacent electrodes.

14. Method as claimed in claim 13, wherein electrical pulses of different amplitude are applied approximately simultaneously to the said electrode or the electrodes.

15. Method as claimed in claim 1, wherein the ions inside the potential well are generated at approximately the potential of the said central electrode in its immediate vicinity.

16. Method as claimed in claim 1, wherein the ions outside the ion source are generated at approximately the potential of the said central electrode and are then introduced into the ion source for storage, the potential distribution in the storage volume being arranged in such a manner that the ions find a potential which is largely repellent in all directions.

17. Method as claimed in claim 16, wherein the ions must overcome a potential barrier at the location of entry into the storage volume.

18. Method as claimed in claim 17, wherein the amplitude of the potential barrier at the location of entry into the storage volume and the potential at which the ions are generated rise slightly in time at the same rate, in which arrangement, however, the potential of the electrodes surrounding the potential well is high enough for keeping the ions in the potential well.

19. A pulsed ion source for time-of-flight spectrometer having a device for emission of an electron, laser or particle beam for generating ions in an ionization volume and forming an ion source and where ions are extracted from the ionization volume by an electrical pulse characterized by the following:

means for forming a storage volume in the region of said ionization volume including at least three electrodes with an intermediate central electrode having a potential more attractive to said generated ions relative to said other of said electrodes to form a potential well for said ions;

and means for generating said electrical pulse for extracting said stored ions from said potential well.

20. A pulsed ion source as claimed in claim 19, wherein the said central electrode consists of a straight or bent metal wire or of a metal wire grid or of a metal frame.

21. A pulsed ion source as claimed in claim 19, wherein the said central electrode is attached approximately in the center between the adjacent electrodes.

22. A pulsed ion source as claimed in claim 20, wherein the distance from the said central electrode to one of the adjacent electrodes is distinctly less than to the other adjacent electrode.

23. A pulsed ion source as in claim 19, in which the ions located in a particular volume are extracted by pulsed and static electrical fields which are arranged behind one another or are wholly or partially superimposed wherein the electrical field is approximately equal in the entire area of acceleration during the extraction of the ions.

24. A pulsed ion source as claimed in claim 19, wherein the electrical pulse for extracting the ions is applied to the said central electrode.

25. A pulsed ion source as claimed in claim 19, wherein the electrical pulse for extracting the ions is applied to the electrode which limits the potential well to the rear.

26. A pulsed ion source as claimed in claim 19, wherein the electrical pulse for extracting the ions is applied to the said central electrode and simultaneously to one or several of the adjacent electrodes.

27. A pulsed ion source as claimed in claim 19, wherein electrical pulses of different amplitude are applied approximately simultaneously to appropriate electrodes.

28. A pulsed ion source as claimed in claim 19 or 23, wherein the ions are generated inside the ion source or in its direct vicinity at approximately the potential of the central electrode.

29. A pulsed ion source as claimed in claim 19 or 23, wherein ions outside the ion source are generated at approximately the potential of the central electrode and are then introduced into the source for the purpose of storage, the potential distribution in the storage volume being arranged in such a manner that the ions find a potential which is largely repellent in all directions.

30. A pulsed ion source as claimed in claim 29, wherein the ions must overcome a potential barrier at the location of entry into the storage volume.

31. A pulsed ion source as claimed in claim 30, wherein the amplitude of a potential barrier at the location of entry of the ions into the storage volume and the potential, at which the ions are generated, rise slightly in time at the same rate, in which arrangement, however, the potential of the electrodes surrounding the potential well is high enough for keeping the ions in the potential well.

* * * * *